US006282718B1

(12) United States Patent
Drakford

(10) Patent No.: US 6,282,718 B1
(45) Date of Patent: Sep. 4, 2001

(54) REMOVABLE CLOTHING

(76) Inventor: Melvin L. Drakford, 51 W. 81st St., New York, NY (US) 10024

( * ) Notice: Subject to any disclaimer, the term of this patent is extended or adjusted under 35 U.S.C. 154(b) by 0 days.

(21) Appl. No.: 09/641,159

(22) Filed: Aug. 17, 2000

(51) Int. Cl.[7] ..... A41B 1/00
(52) U.S. Cl. ..... 2/70; 2/115
(58) Field of Search ..... 2/70, 113, 116, 2/129, 119, 121, 122, 114, 115, 139, 140, 69.5, 69

(56) References Cited

U.S. PATENT DOCUMENTS

| | | | | |
|---|---|---|---|---|
| 286,781 | * | 10/1883 | Cleveland . | |
| 1,489,046 | * | 4/1924 | Thompson . | |
| 2,471,543 | * | 5/1949 | Riggs | 2/128 |
| 2,807,022 | | 9/1957 | Bonanni . | |
| 2,915,759 | * | 12/1959 | Parfect | 2/116 |
| 2,997,718 | * | 8/1961 | Jacobs | 2/139 |
| 3,079,611 | * | 3/1963 | Boryszewski | 2/89 |
| 3,116,491 | * | 1/1964 | Previdi et al. | 2/106 |
| 3,170,165 | * | 2/1965 | Wise | 2/116 |
| 3,288,157 | * | 11/1966 | Szkolny | 135/5 |
| 3,490,072 | | 1/1970 | Keltner | 2/114 |
| 4,434,511 | | 3/1984 | Weiser | 2/114 |
| 4,453,274 | * | 6/1984 | Allen | 2/102 |
| 4,957,466 | * | 9/1990 | Hopps | 450/85 |
| 5,062,159 | * | 11/1991 | Jakub | 2/114 |
| 5,564,123 | * | 10/1996 | Grassick | 2/69 |
| 5,603,123 | * | 2/1997 | Chupa | 2/275 |
| 5,611,083 | * | 3/1997 | Arnold | 2/84 |
| 5,611,087 | * | 3/1997 | Adkins | 2/114 |
| 5,628,064 | * | 5/1997 | Chung | 2/70 |
| 5,956,769 | * | 9/1999 | Stepney | 2/129 |
| 6,185,743 | * | 2/2001 | Mick | 2/84 |

* cited by examiner

*Primary Examiner*—John J. Calvert
*Assistant Examiner*—Alissa L. Hoey
(74) *Attorney, Agent, or Firm*—Walter J. Tencza, Jr.

(57) ABSTRACT

A method is provided comprising the steps of placing a first shirt on, placing a second shirt over the first shirt, and removing the first shirt while the second shirt is on. The method may be further comprised of playing tennis after placing the first shirt on and playing tennis after placing the second shirt over the first shirt and removing the first shirt while the second shirt is on. The first shirt may be comprised of a first portion and a second portion. The first portion of the shirt may have a first attachment device. The second portion of the shirt may have a second attachment device. The first attachment device can be attached to the second attachment device in order to attach the first portion to the second portion. The second attachment device can be detached from the second attachment device in order to detach the first portion from the second portion. Also disclosed is a shirt comprised of a first portion including a collar which has first attachment device and a second portion which has a second attachment device. The first attachment device of the collar can be attached to the second attachment device in order to attach the collar to the second portion of the shirt. The first attachment device can be detached from the second attachment device in order to detach the collar from the second portion of the shirt. The general public can use the changeable garments in populated places like airports or train stations when a dressing room or other secluded place may not be convenient or available to change from one shirt to another without fear of personal exposure.

13 Claims, 12 Drawing Sheets

REMOVABLE CLOTHING

FIELD OF THE INVENTION

This invention relates to improved methods and apparatus for allowing individuals to easily remove clothing.

BACKGROUND OF THE INVENTION

Individuals for certain purposes may need to easily remove articles of clothing. This is particularly true for athletes.

SUMMARY OF THE INVENTION

The present invention in one embodiment provides changeable clothes that allow a person to change their clothing in public without exposing themselves. The changeable clothes may include fasteners or attachment devices which allow a wearer to put on a new set of clothes over the old set and to thereafter take off the old set of clothes. The attachment devices which make this possible may include VELCRO (trademarked), zippers, buttons, and other devices. A first set of changeable clothes can easily be fastened together through the attachment devices or taken apart and slipped off after a second set of changeable clothes is placed over the first. The attachment devices can be provided so that they provide full freedom of movement and do not substantially hinder movement of an individual.

The changing operation can be accomplished in seconds. This is particularly useful for a changeover in tennis. A tennis player, during a changeover, may place a second shirt for example over a first shirt and then while the second shirt is over the first shirt, may detach attachment devices on the first shirt and remove the first shirt.

The changeable apparel is particularly useful in sports and especially in women's sports, particularly women's tennis. The rules of tennis prohibit a player from leaving the tennis court once the match begins except for a brief bathroom break, thereby inhibiting women tennis players from changing their shirts, during the match, as men do, even though women's shirts become sweaty and uncomfortable during the course of the match. Some men players change their shirts as often as six to ten times during a match. With embodiments of the present invention, a woman tennis player could change her top on the court as often as necessary without any fear of exposure to the public. The general public can use the changeable garments to change from working clothes to evening clothes eliminating the need for a dressing room or seclusion. The general public can also use the changeable garments or shirts to change in populated places like airports or train stations when a dressing room or other secluded place may not be convenient or available to change from one shirt to another without fear of personal exposure.

The present invention in one embodiment provides a method comprising the steps of placing a first shirt on. The method may be further comprised of playing tennis with the first shirt on and after becoming sweaty, a second shirt may be placed over the first shirt, with the underneath first shirt being removable. The method may further comprise removing the first shirt while the second shirt is on and playing tennis thereafter with the second shirt on.

The first shirt may be comprised of a first portion and a second portion. The first portion of the shirt may have a first attachment device. The second portion of the shirt may have a second attachment device. The first attachment device can be attached to the second attachment device in order to attach the first portion to the second portion. The second attachment device can be detached from the second attachment device in order to detach the first portion from the second portion. The first shirt is removed by detaching the first attachment device from the second attachment device while the second shirt is on.

The first and the second attachment devices may be comprised of first and second VELCRO (trademarked) portions, respectively, or other appropriate fasteners. The first and second attachment devices may each be comprised of a plurality of attachment portions, which may include first, second, third, and fourth attachment portions for each attachment device.

The first portion of the shirt may have a left shoulder area, a right shoulder area, a left side area, and a right side area. The second portion of the shirt may have a left shoulder area, a right shoulder area, a left side area, and a right side area. The first and second attachment portions of the first attachment device may be located near the left and right shoulder areas, respectively of the first portion. The third and fourth attachment portions of the first attachment device are located near the left and right side areas, respectively of the first portion. The first and second attachment portions of the second attachment device are located near the left and right shoulder areas, respectively of the second portion. The third and fourth attachment portions of the second attachment device are located near the left and right side areas, respectively of the second portion.

The present invention in one embodiment also provides an apparatus comprised of a shirt comprised of a first portion and a second portion. The first portion of the shirt may have a collar which has first attachment device. The second portion of the shirt may have a second attachment device. The first attachment device of the collar can be attached to the second attachment device in order to attach the collar to the second portion of the shirt. The first attachment device can be detached from the second attachment device in order to detach the collar from the second portion of the shirt. The garment or shirt provided may be constructed so that after washing it can be used repeatedly.

DETAILED DESCRIPTION OF THE DRAWINGS

Figure 1A:
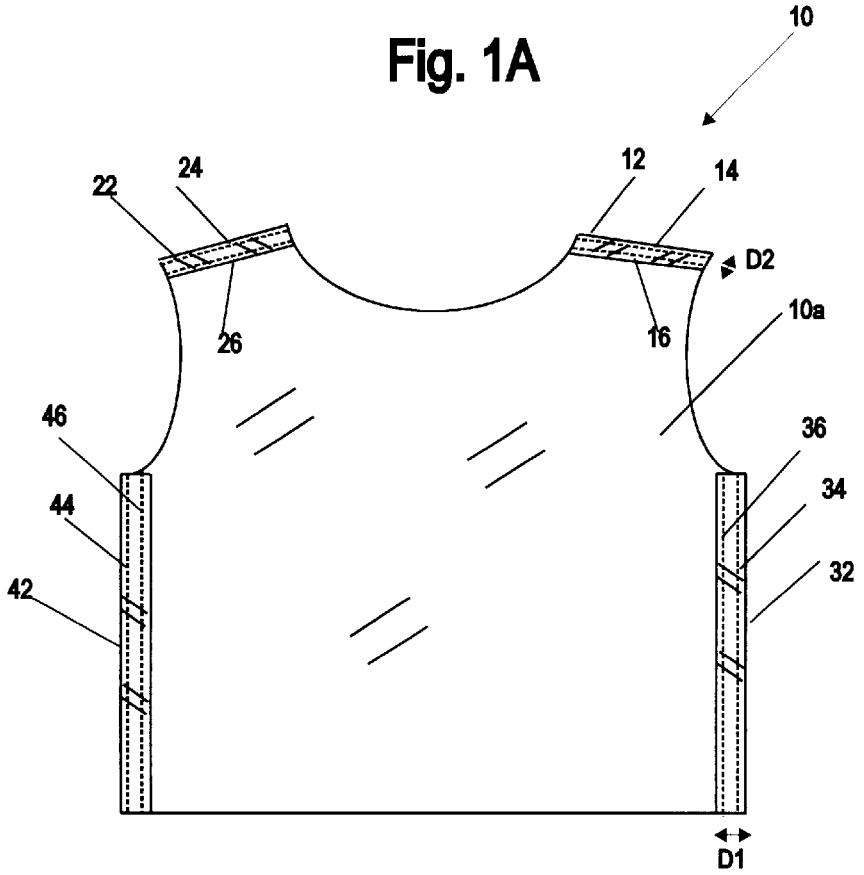
FIGS. 1A and 1B show first and second sides of a first portion of a removable shirt in accordance with a first embodiment of the present invention.
Figure 1B:
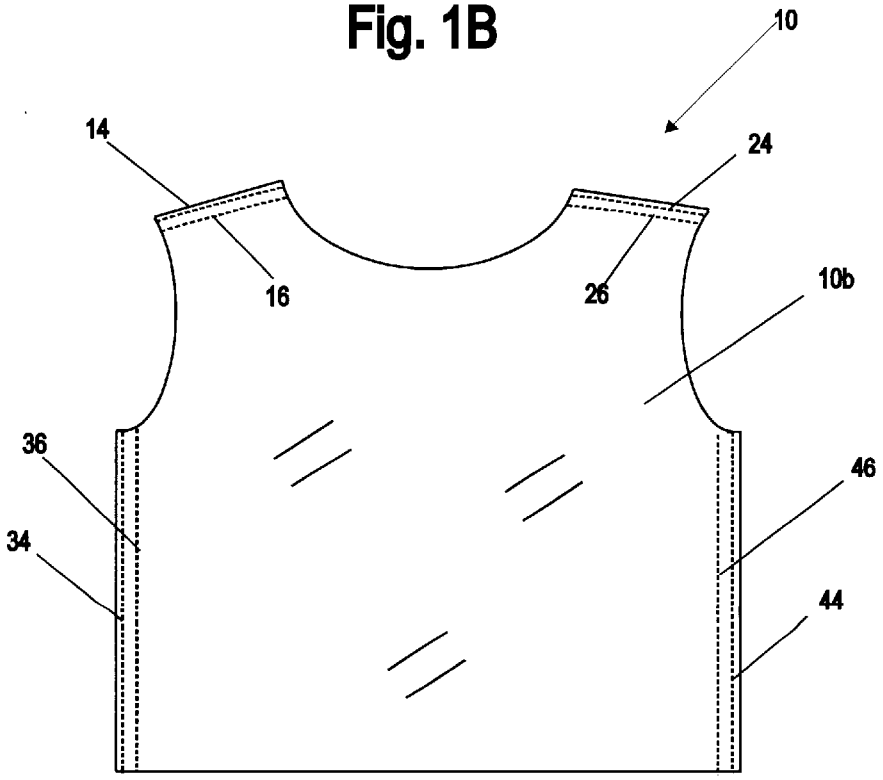

FIGS. 1A and 1B show a first side 10*a* and a second side 10*b*, respectively, of a first portion 10 of a removable shirt in accordance with a first embodiment of the present invention.

The first side 10*a* is comprised of a attachment portions 12, 22, 32, and 42 as shown by FIG. 1A. The attachment portions 12, 22, 32, and 42 each may be a Velcro (trademarked) portion. Each Velcro (trademarked) portion 12, 22, 32, and 42 may be stitched to the first side 10*a*. Portion 12 may be stitched by stitches 14 and 16; portion 22 may be stitched by stitches 24 and 26; portion 32 may be stitched by stitches 34 and 36; and portion 42 may be stitched by stitches 44 and 46. The stitches 14, 16, 24, 26, 34, 36, 44, and 46 are shown in dashed lines in FIGS. 1A and 1B, to show that they go in an out of the first portion 10 of the removable shirt, so that portions of the stitches appear on side 10*a* and portions appear on side 10*b* shown in FIG. 1B.

The portion 10 of the removable shirt (disregarding the attachment portions and the stitches) may be made of cotton or any other fabric.

FIG. 1B shows the second side 10*b* of the portion 10. The attachment portions 12, 22, 32, and 42, (i.e. if Velcro (trademarked), the actual Velcro) does not appear on the second side 10*b*.

Figure 2A:
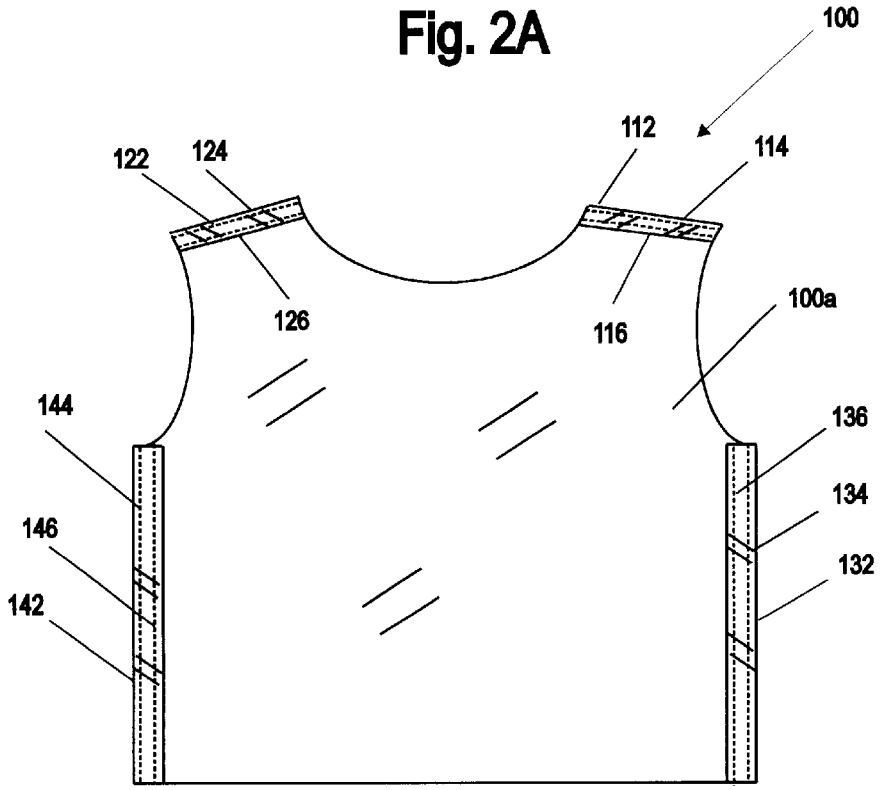
FIGS. 2A and 2B show first and second sides of a second portion of a removable shirt in accordance with the first embodiment of the present invention.
Figure 2B:
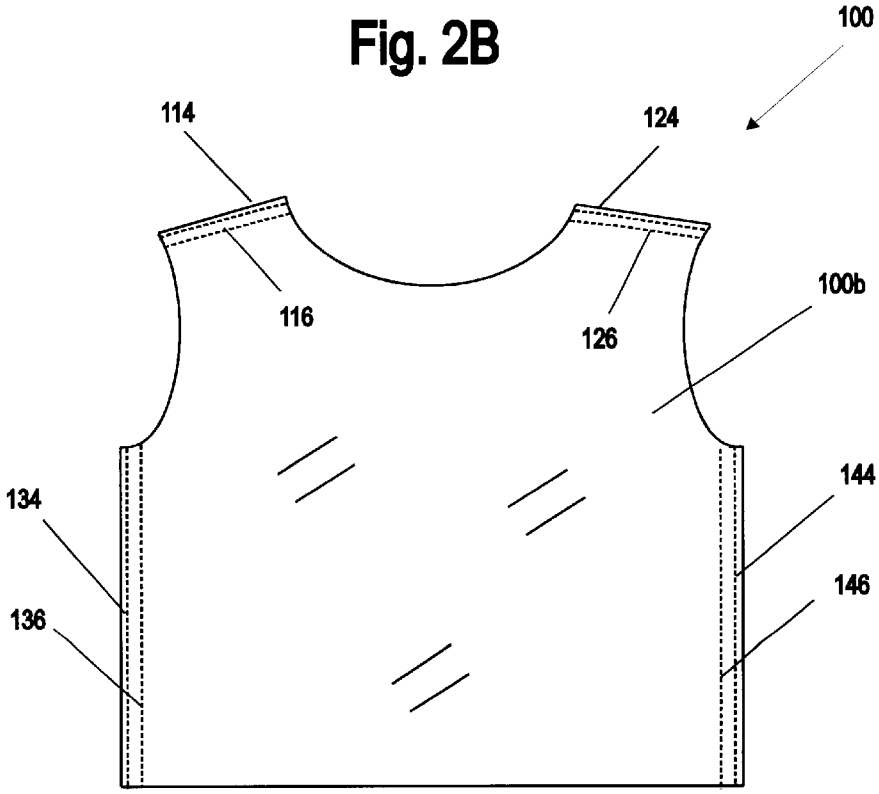

FIGS. 2A and 2B show a first side 100*a* and a second side 100*b* of a second portion 100 of a removable shirt in accordance with a first embodiment of the present invention. The first side 100*a* is comprised of a attachment portions 112, 122, 132, and 142 as shown by FIG. 2A. The attachment portions 112, 122, 132, and 142 each may be a Velcro (trademarked) portion. The attachment portions 112, 122, 132 and 142 of the second portion 100 of the shirt should be able to mate, link, and/or attach to the attachment portions 22, 12, 42, and 32, respectively, of the first portion 10 of the shirt, in order to join the first portion 10 and the second portion 100 together to form a shirt. The attachment portions 112, 122, 132, and 142 may be hooks of a VELCRO (trademarked) system, while the attachment portions 22, 12, 42, and 32 may be loops of a VELCRO (trademarked) system.

Each attachment portion 112, 122, 132, and 142 may be stitched to the first side 100*a* of the second portion 100. Portion 112 may be stitched by stitches 114 and 116; portion 122 may be stitched by stitches 124 and 126; portion 132 may be stitched by stitches 134 and 136; and portion 142 may be stitched by stitches 144 and 146. The stitches 114, 116, 124, 126, 134, 136, 144, and 146 are shown in dashed lines in FIGS. 2A and 2B, to show that they go in an out of the second portion 100 of the removable shirt, so that portions of the stitches appear on side 100*a* and portions appear on side 100*b* shown in FIG. 2B.

The portion 100 of the removable shirt (disregarding the attachment portions and the stitches) may be made of cotton or any other fabric. FIG. 2B shows the second side 100*b* of the portion 10. The attachment portions 112, 122, 132, and 142, (i.e. if VELCRO (trademarked), the actual Velcro) does not appear on the second side 100*b*.

Figure 3A:
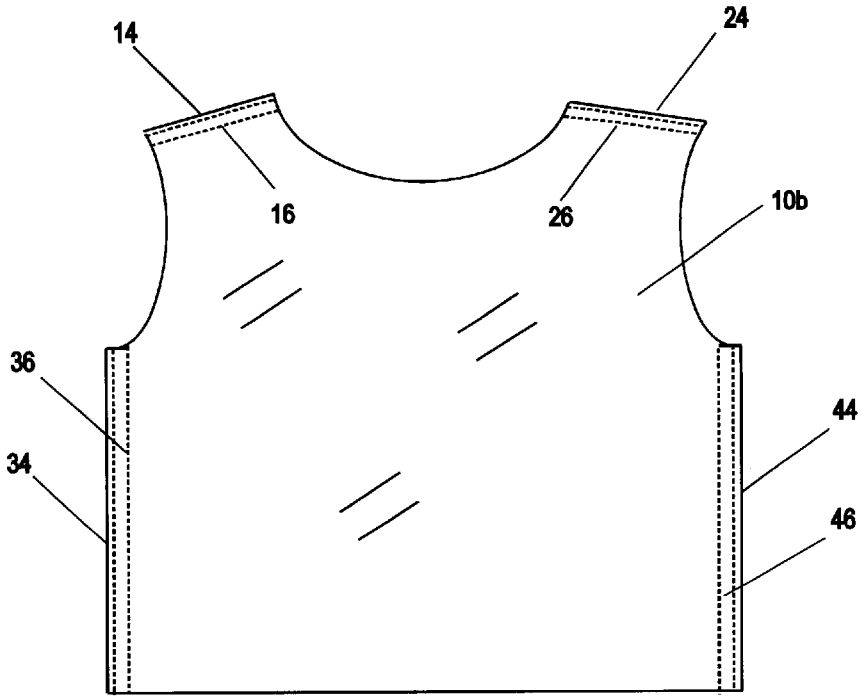
FIGS. 3A and 3B show first and second sides of a removable shirt formed from the first and second portions of FIGS. 1A–B and 2A–B.
Figure 3B:
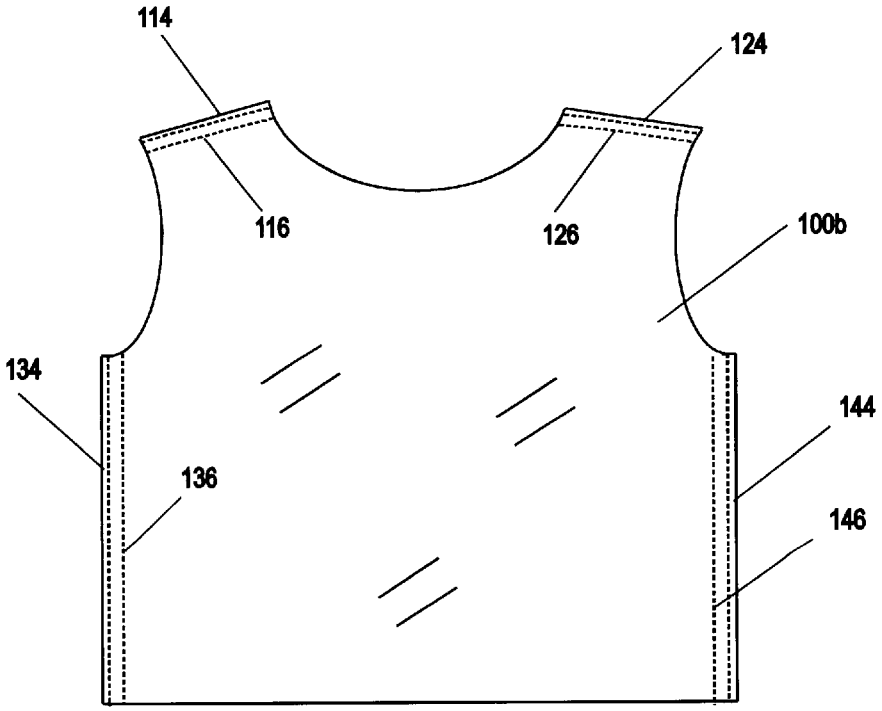

FIGS. 3A and 3B show the side 10*b* and the side 100*b* of a removable shirt 150 formed from the first portion 10 and the second portion 100 of FIGS. 1A–B and 2A–B. The first portion 10 is attached to the second portion 100 so that the side 10*a* faces towards the side 100*a*. The attachment portions 12, 22, 32, and 42 are attached to the attachment portions 122, 112, 142, and 132, respectively. The attachment portions are attached in such a manner that the attachment portions can not be seen from the outside of the shirt 150. The attachment portions 12, 22, 32, and 42 can be thought of as being part of an overall attachment device. The attachment portions 122, 112, 142, and 132 can also be thought of as being part of an overall attachment device.

Figure 4:
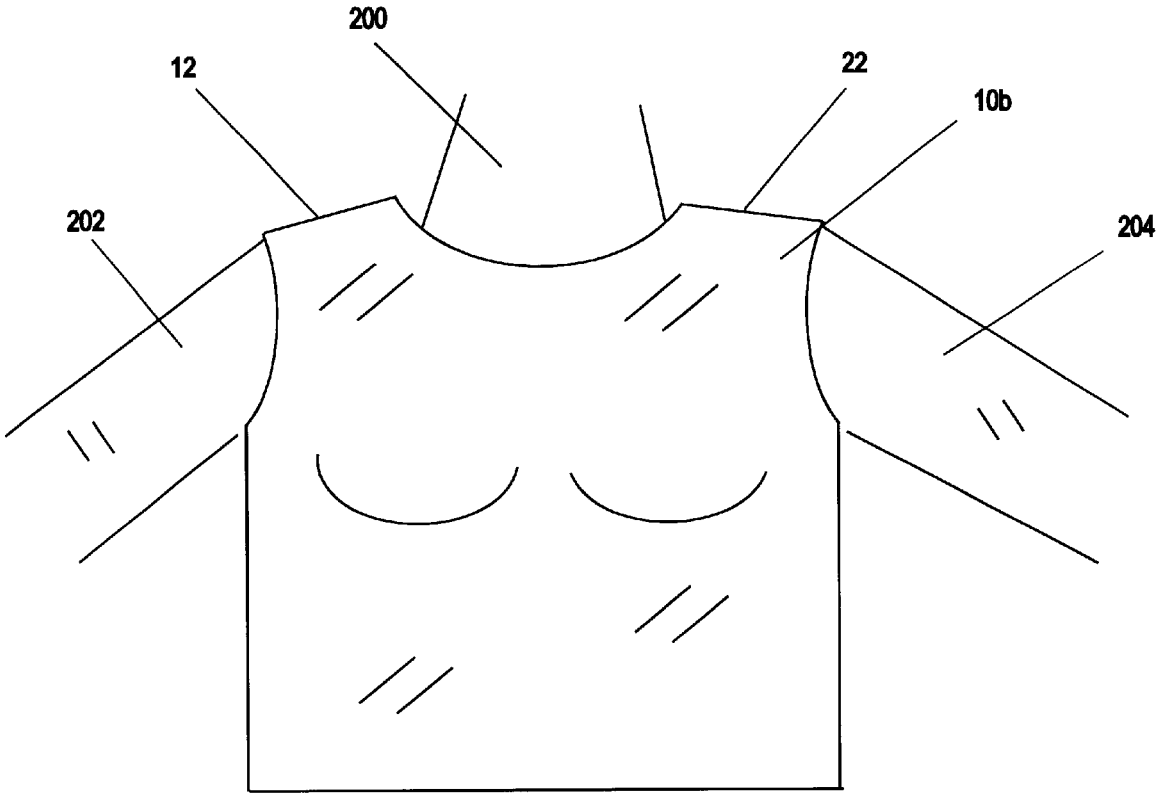
FIG. 4 shows the removable shirt of FIGS. 3A and 3B as it would appear from a front view on a female mannequin or a female individual.

FIG. 4 shows the removable shirt 150 of FIGS. 3A and 3B as it would appear from a front view on a female mannequin 200 or a female individual. The female mannequin 200 shown includes a neck 201, a left arm 202, and a right arm 204. The stitches 16 and 26 are located on the left and right shoulders, respectively, of the female mannequin 200. The stitches 36 and 46 run along the left and right sides, respectively, of the female mannequin 200. The general location of these stitches is shown by FIG. 4, although the stitches 14, 16, 24, 26, 36, and 46 would not generally be viewable, or would be difficult to view, from a front view of the mannequin 200. The stitches 14, 16, 24, and 26 run along the shoulders and the stitches 34, 36, 44, and 46 run along the sides of the mannequin 200.

Figure 5:
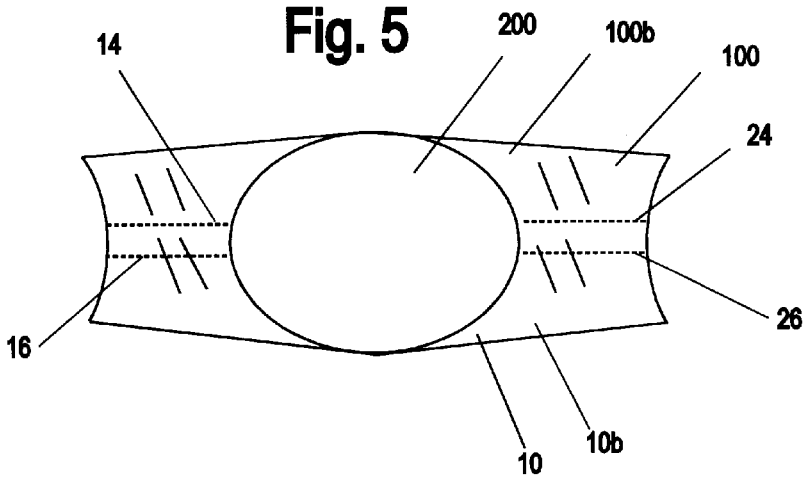
FIG. 5 shows a top view of the shoulder area of the removable shirt as it would appear if worn on a mannequin or a female individual.

FIG. 5 shows a top partial view of the shoulder area of the removable shirt 150 as it would appear if worn on a mannequin or a female individual 200. FIG. 5 also shows the locations of side 10*b* and side 100*b* and the location of neck 201.

Figure 6:
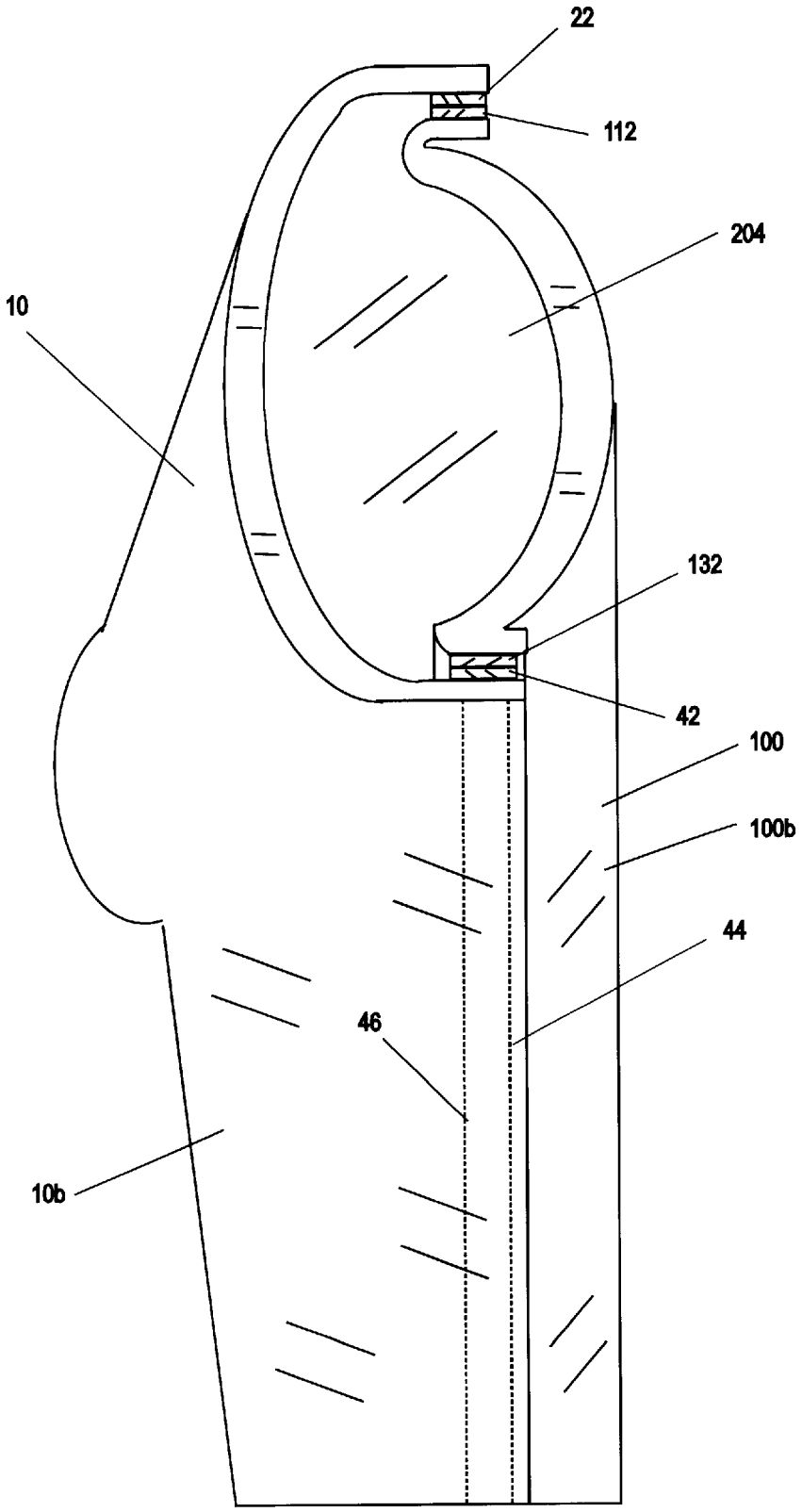
FIGS. 6–7 show right and left side views, respectively, of the removable shirt of the first embodiment as the shirt would appear on a mannequin or a female individual.
Figure 7:
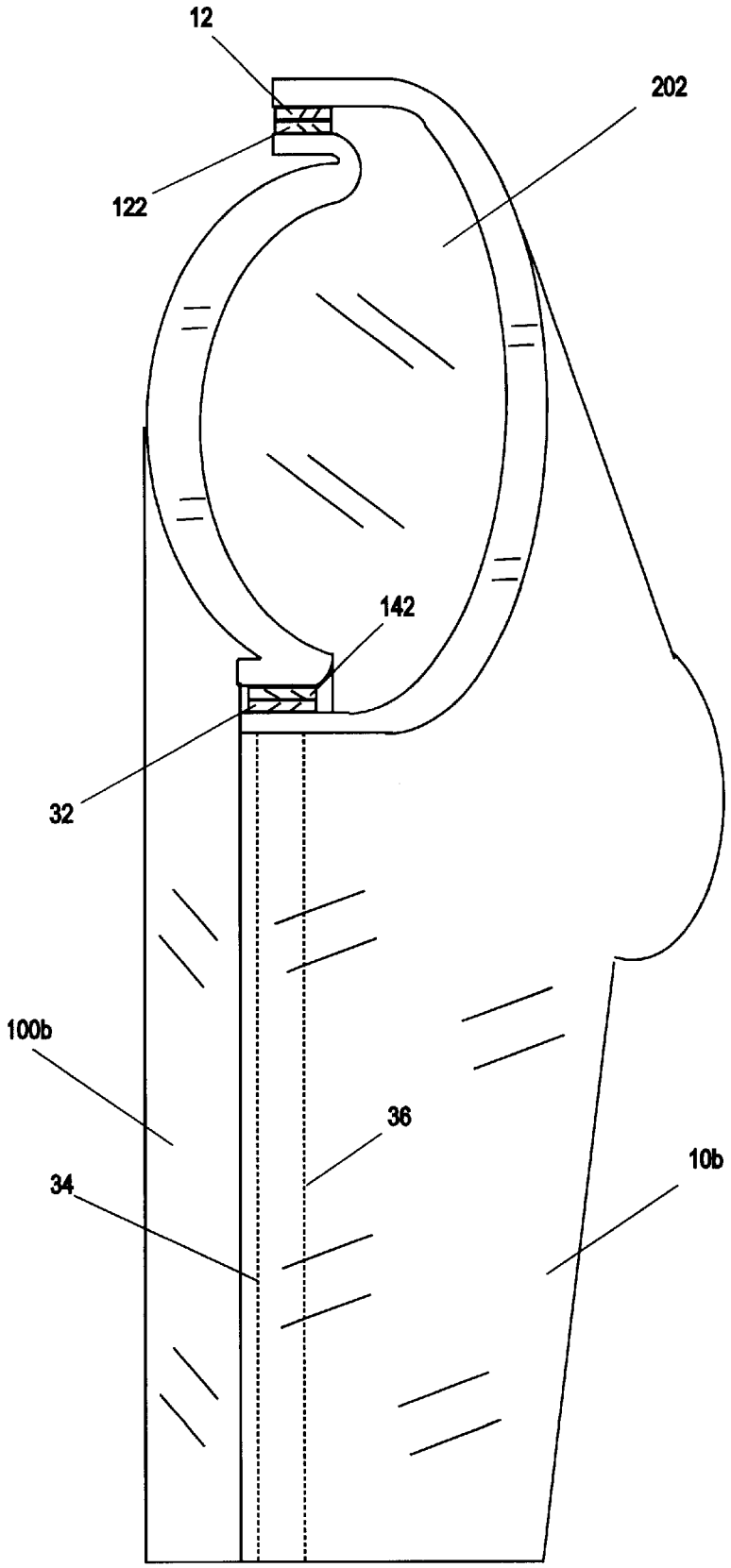

FIGS. 6–7 show right and left side views, respectively, of the removable shirt 150 of the first embodiment as the shirt 150 would appear on a mannequin 210 or a female individual. The mannequin 210 has a trunk 211. FIG. 6 shows the joining of attachment portion 132 (which may be a VELCRO portion) to attachment portion 42 (which may be a mating VELCRO portion). Attachment portions 132 and 42 are joined along the entire right side, except for the opening 151 where the right arm would go. The locations of stitches 46 and 44 are also shown in FIG. 6. FIG. 6 shows side 10*b* of portion 10 and side 100*b* of portion 100. FIG. 6 also shows the joining of attachment portion 112 with attachment portion 12 in the shoulder area. In FIG. 6, the portion 100 has a loop or folded over portion 101 a where the attachment portion 112 is attached to the portion 100 and a loop of folder over portion 101*b* where the attachment portion 132 is attached to the portion 100.

FIG. 7 shows the joining of attachment portion 142 (which may be a VELCRO portion) to attachment portion 32 (which may be a mating VELCRO portion). Attachment portions 142 and 32 are joined along the entire left side, except for the opening 152 where the left arm would go. The locations of stitches 36 and 34 are also shown in FIG. 7. FIG. 7 shows side 10*b* of portion 10 and side 100*b* of portion 100. FIG. 7 also shows the joining of attachment portion 12 with attachment portion 122 in the shoulder area. In FIG. 7, the portion 100 has a loop or folded over portion 103*a* where the attachment portion 12 is attached to the portion 100 and a looped over or folded over portion 103*b* where the attachment portion 142 is attached to the portion 100.

In operation an individual would attach portion 10 to portion 100 as shown by FIGS. 3A–3B. The individual can then use the resulting removable shirt 150. When the individual is done with the removable shirt 150, she may pull the different attachment portions apart to remove the shirt 150. The attachment portions 12, 22, 32, and 42 would each be removed, disconnected, or unattached from the attachment portions 122, 112, 142, and 132, respectively. An individual can perform this removal or unattachment operation while the individual has another shirt on. Thus for a changeover in tennis, an individual, particularly a woman, can place a new shirt over the removable shirt, and then remove the removable shirt 150. This allows a female tennis player to replace a sweaty shirt without exposing herself in public.

Figure 8A:
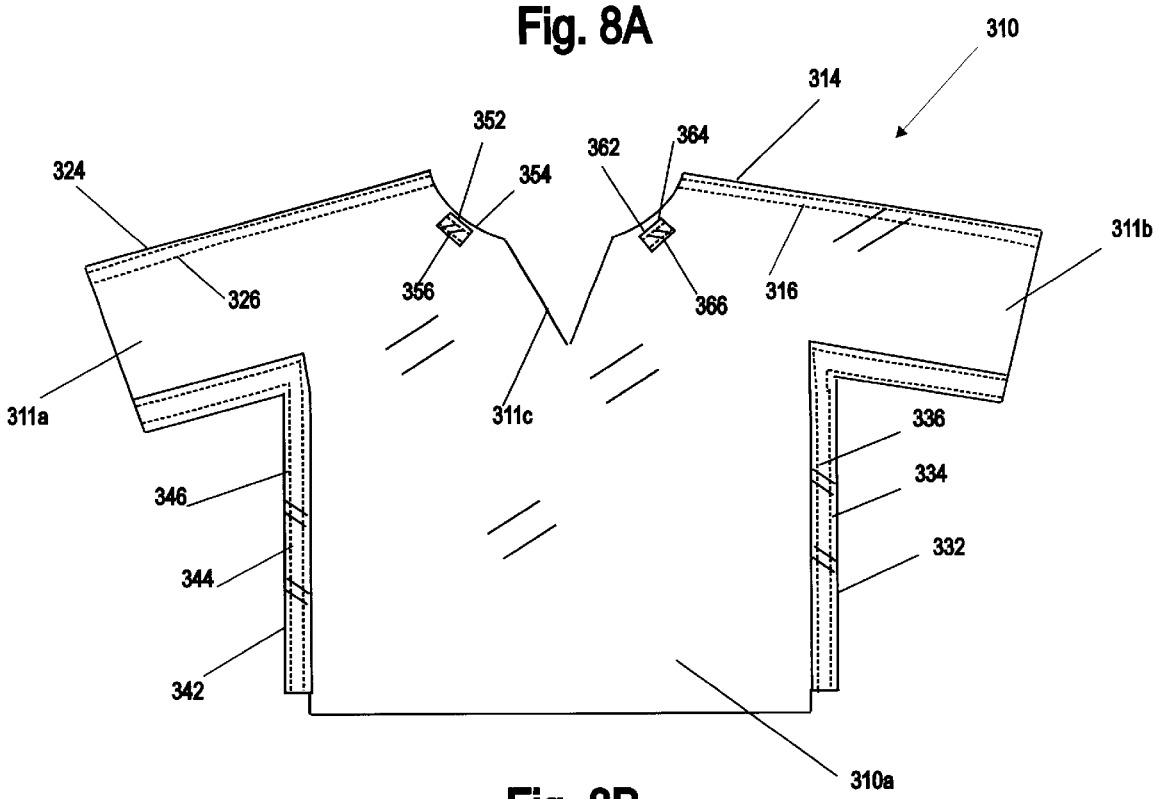
FIGS. 8A–8B show first and second sides of a first portion of a removable shirt in accordance with a second embodiment of the present invention.
Figure 8B:
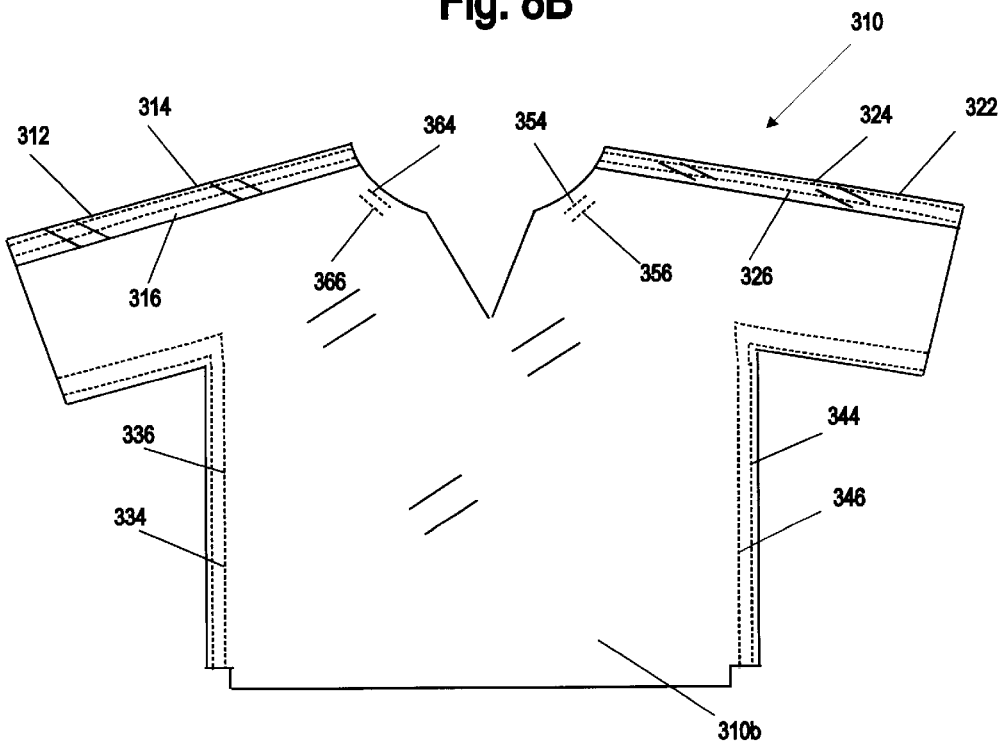

FIGS. 8A and 8B show a first side 310*a* and a second side 310*b*, respectively, of a first portion 310 of a removable shirt in accordance with a second embodiment of the present invention.

The first side 310*a* is comprised of a attachment portions 342 and 332 as shown by FIG. 8A. The attachment portion 342 may be stitched to side 310*a* by stitches 344 and 346 and the attachment portion 332 may be stitched to side 310*b* by stitches 334 and 336. The second side 310*b* is comprised of a attachment portions 312 and 322 as shown by FIG. 8B. The attachment portion 312 may be stitched to side 310*b* by stitches 314 and 316 and the attachment portion 322 may be stitched to side 310*b* by stitches 324 and 326.

The attachment portions 312, 322, 332, and 342 each may each be a Velcro (trademarked) portion. The stitches 314, 316, 324, 326, 334, 336, 344, and 346 are shown in dashed lines in FIGS. 8A and 8B, to show that they go in an out of the first portion 310 of the removable shirt of the second embodiment, so that portions of the stitches appear on side 310*a* as shown in FIG. 8A and portions appear on side 310*b* shown in FIG. 8B.

The portion 310 also includes attachment portion 352 which is stitched onto side 310*a* by stitches 354 and 356 and attachment portion 362 which is stitched onto side 310*a* by stitches 364 and 366. The stitches 354, 356, 364, and 366 are shown in dashed lines to show that they go in and out of portion 310 so that portion of the stitches appear on side 310*a* and portions appear on side 310*b*.

The portion 310 of the removable shirt (disregarding the attachment portions and the stitches) may be made of cotton or any other fabric. The attachment portions 342, 332, 352, and 362 appear on side 310*a* and not on side 310*b*, while the attachment portions 322 and 312 appear on side 310*b* and not on side 310*a*.

Figure 9A:
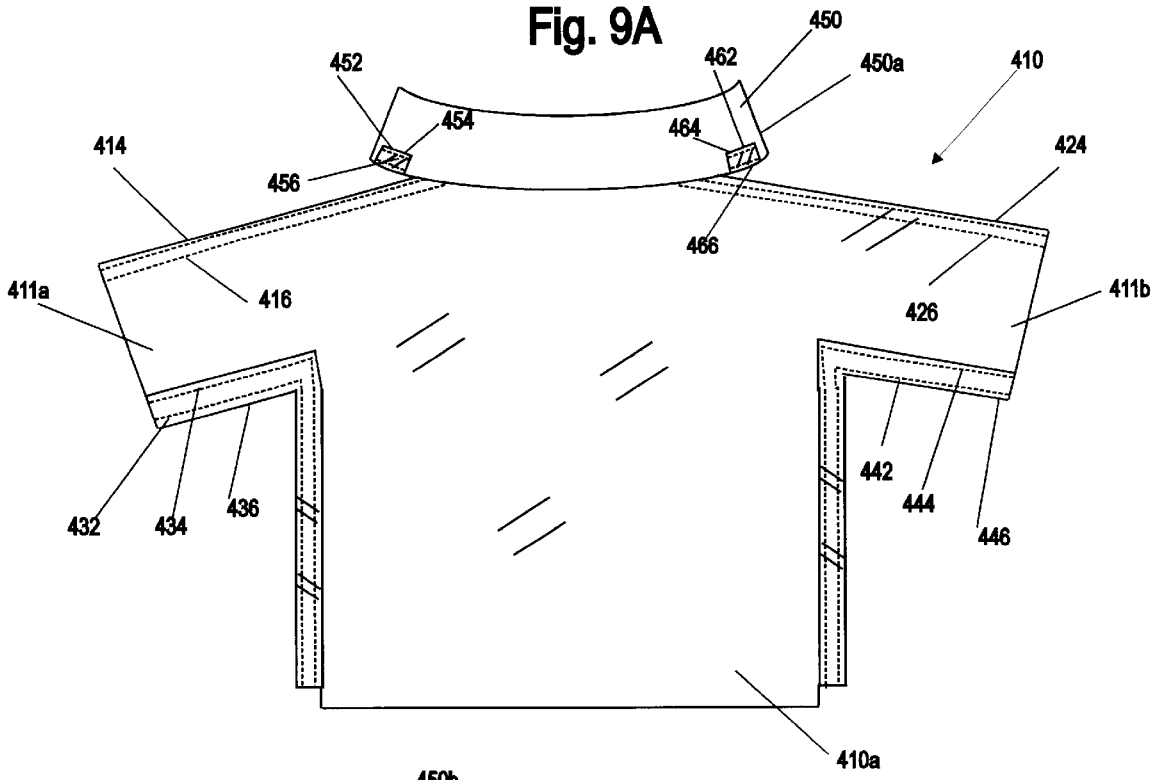
FIGS. 9A and 9B show first and second sides of a second portion of a removable shirt in accordance with the second embodiment of the present invention.
Figure 9B:
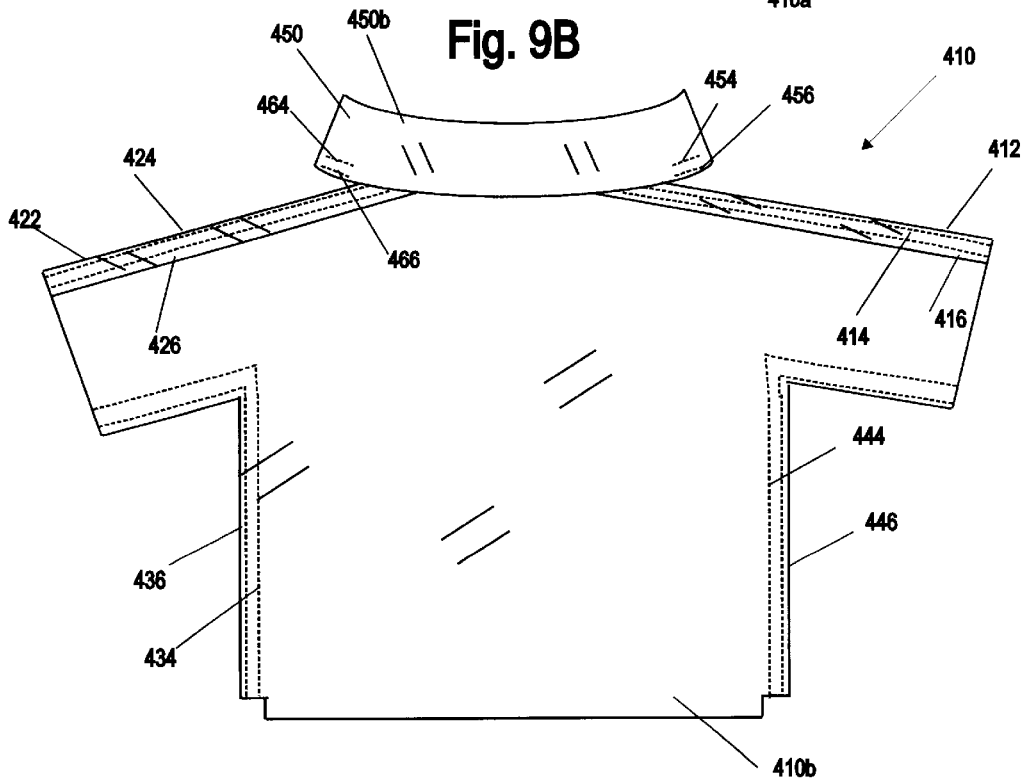

FIGS. 9A and 9B show a first side 410*a* and a second side 410*b* of a second portion 410 of a removable shirt in accordance with a second embodiment of the present invention. The first side 410*a* is comprised of attachment portions 432, 442, 452, and 462 as shown by FIG. 9A. The attachment portions 432, 442, 452 and 462 each may be a Velcro (trademarked) portion. The attachment portions 432, 442, 452 and 462 of the second portion 410 of the shirt should be able to mate, link, and/or attach to the attachment portions 332, 342, 362, and 352, respectively, of the first portion 310 of the shirt, in order to join the first portion 310 and the second portion 410 together to form a shirt 470 shown in FIG. 10A and to properly attach the collar 450. The attachment portions 432, 442, 452, and 462 may be hooks of a VELCRO (trademarked) system, while the attachment portions 332, 342, 362, and 352 may be loops of a VELCRO (trademarked) system.

The second side 410*b* is comprised of attachment portions 412 and 422 as shown by FIG. 9B. The attachment portions 412 and 422 each may be a Velcro (trademarked) portion. The attachment portions 412 and 422 of the second portion 410 of the shirt should be able to mate, link, and/or attach to the attachment portions 312 and 322, respectively, of the first portion 310 of the shirt, in order to join the first portion 310 and the second portion 410 together to form a shirt 470 shown in FIGS. 10A–10B. The attachment portions 412 and 422 may be hooks of a VELCRO (trademarked) system, while the attachment portions 312 and 322 may be loops of a VELCRO (trademarked) system.

Each attachment portion 412, 422, 432, 442, 452, and 462 may be stitched to the side to which it is connected. Attachment portion 412 may be stitched by stitches 414 and 416; attachment portion 422 may be stitched by stitches 424 and 426; attachment portion 432 may be stitched by stitches 434 and 436; attachment portion 442 may be stitched by stitches 444 and 446; attachment portion 452 may be stitched by stitches 454 and 456; and attachment portion 462 and may be stitched by stitches 464 and 466.

Figure 10A:
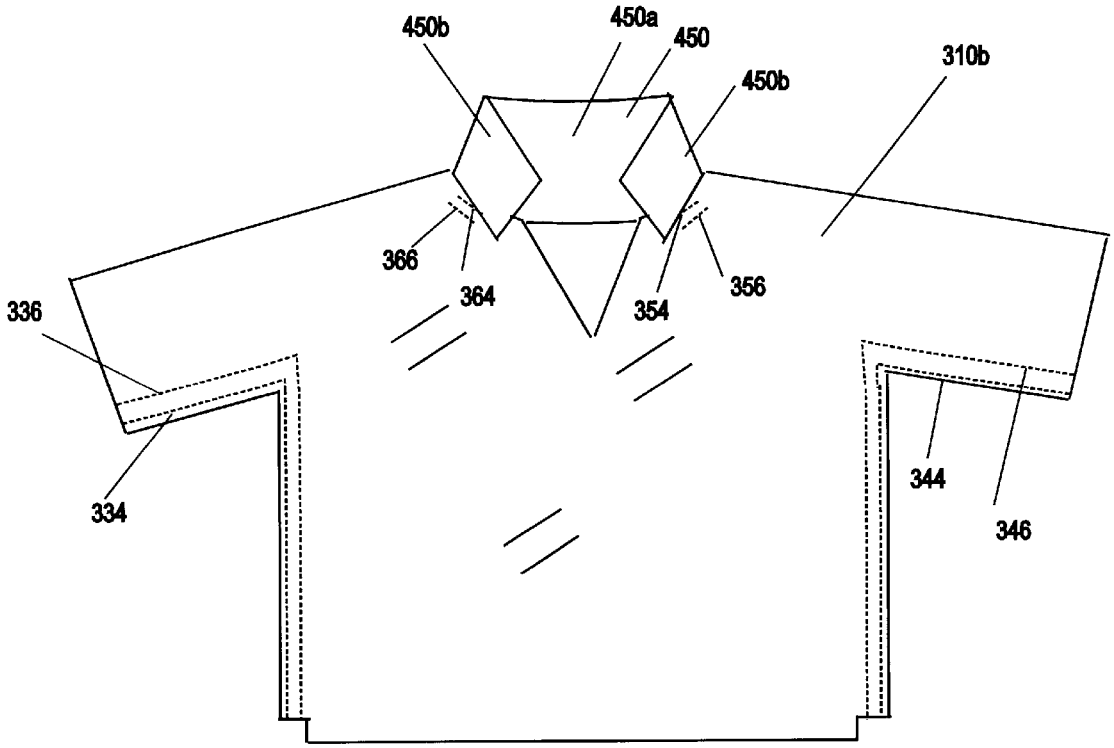
FIGS. 10A and 10B show first and second sides of a removable shirt of a second embodiment of the present invention formed from the first and second portions of FIGS. 8A–B and 9A–B.
Figure 10B:
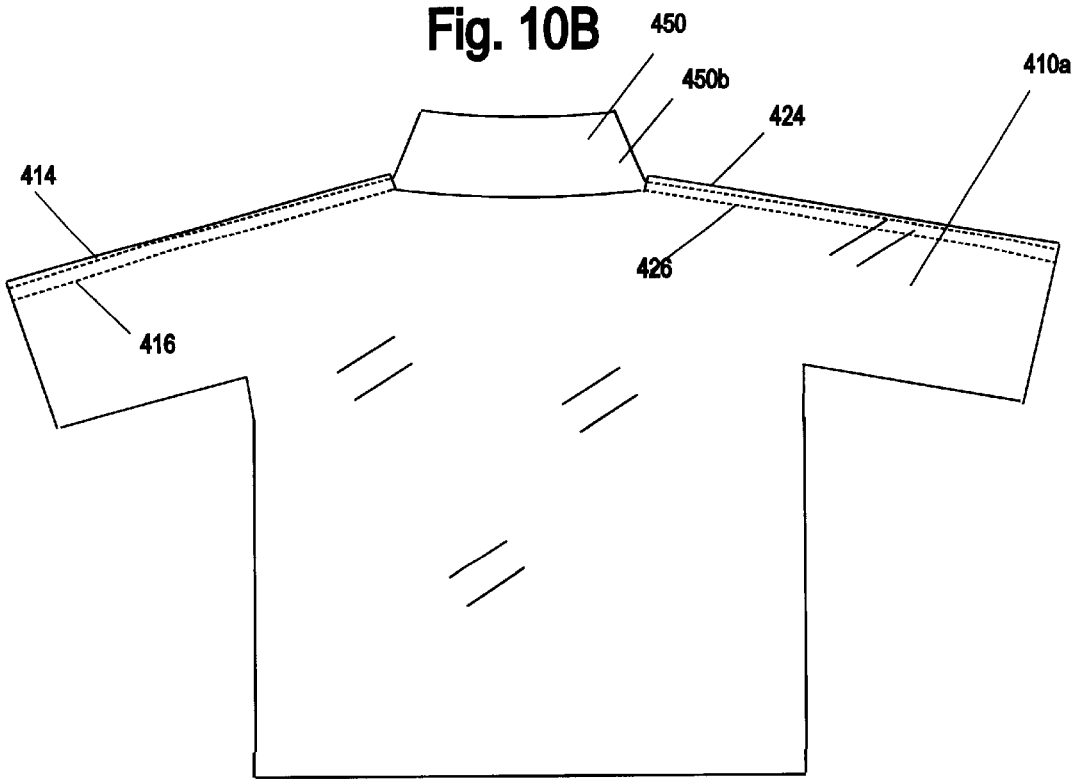

FIGS. 10A and 10B show the side 310*b* and the side 410*a* of a removable shirt 470 formed from the first portion 310 and the second portion 410 of FIGS. 8A–B and 9A–B, respectively. The first portion 310 is attached to the second portion 410 so that the side 310*a* faces towards the side 410*b*. The attachment portions 412, 422, 432, 442, 452, and 462 are attached to the attachment portions 322, 312, 332, 342, 352, and 362 respectively. The attachment portions are attached in such a manner that the attachment portions can not be seen from the outside of the shirt 470.

Figure 11:
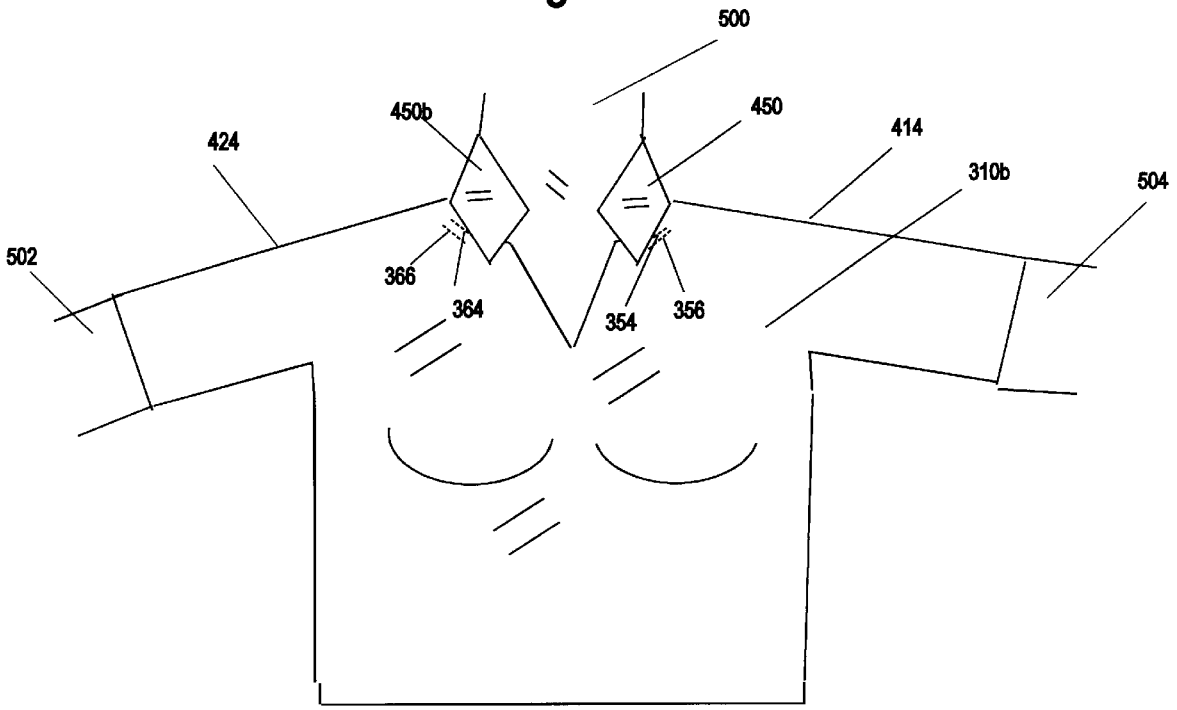
FIG. 11 shows the removable shirt of FIGS. 10A and 10B as it would appear from a front view on a female mannequin or a female individual.

FIG. 11 shows the removable shirt 470 of FIGS. 10A and 10B as it would appear from a front view on a female mannequin 500 or a female individual. The female mannequin 500 shown includes a neck 501, a left arm 502, and a right arm 504. The stitches 424 and 414 are located on the left and right shoulders, respectively, of the female mannequin 500. The stitches 336 and 346 run along the left and right sides, respectively, of the female mannequin 500. The general location of these stitches is shown by FIG. 11, although the stitches 414, 416, 424, 426, 436, 446, 456, and 466 would not generally be viewable, or would be difficult to view, from a front view of the mannequin 500. However, the stitches 456 and 466 may be viewable from a front view. The stitches 414, 416, 424, and 426 run along the shoulders and the stitches 434, 436, 444, and 446 run along the sides of the mannequin 500. The stitches 456 and 466 run under the collar 450.

Figure 12:
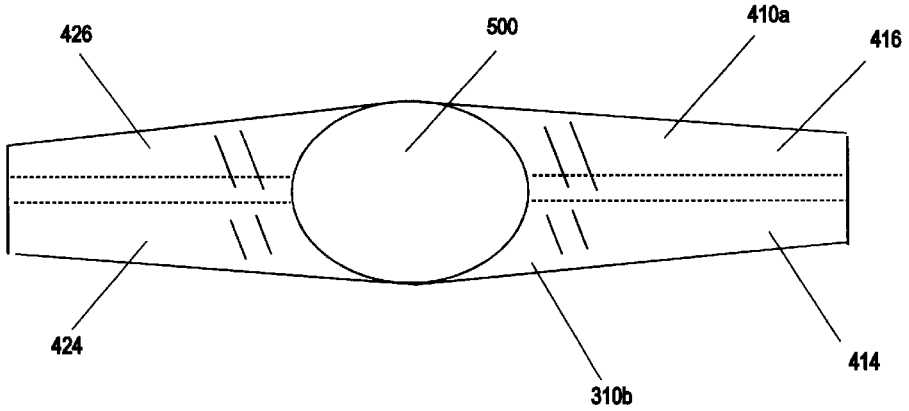
FIG. 12 shows a top view of the shoulder area of the removable shirt of the second embodiment as it would appear if worn on a mannequin or a female individual.

FIG. 12 shows a top partial view of the shoulder area of the removable shirt 470 as it would appear if worn on a mannequin or a female individual 500. FIG. 5 also shows the locations of side 310*b* and side 410*a* and the location of neck 501 and the location of stitches 424, 426, 414, and 416.

Figure 13:
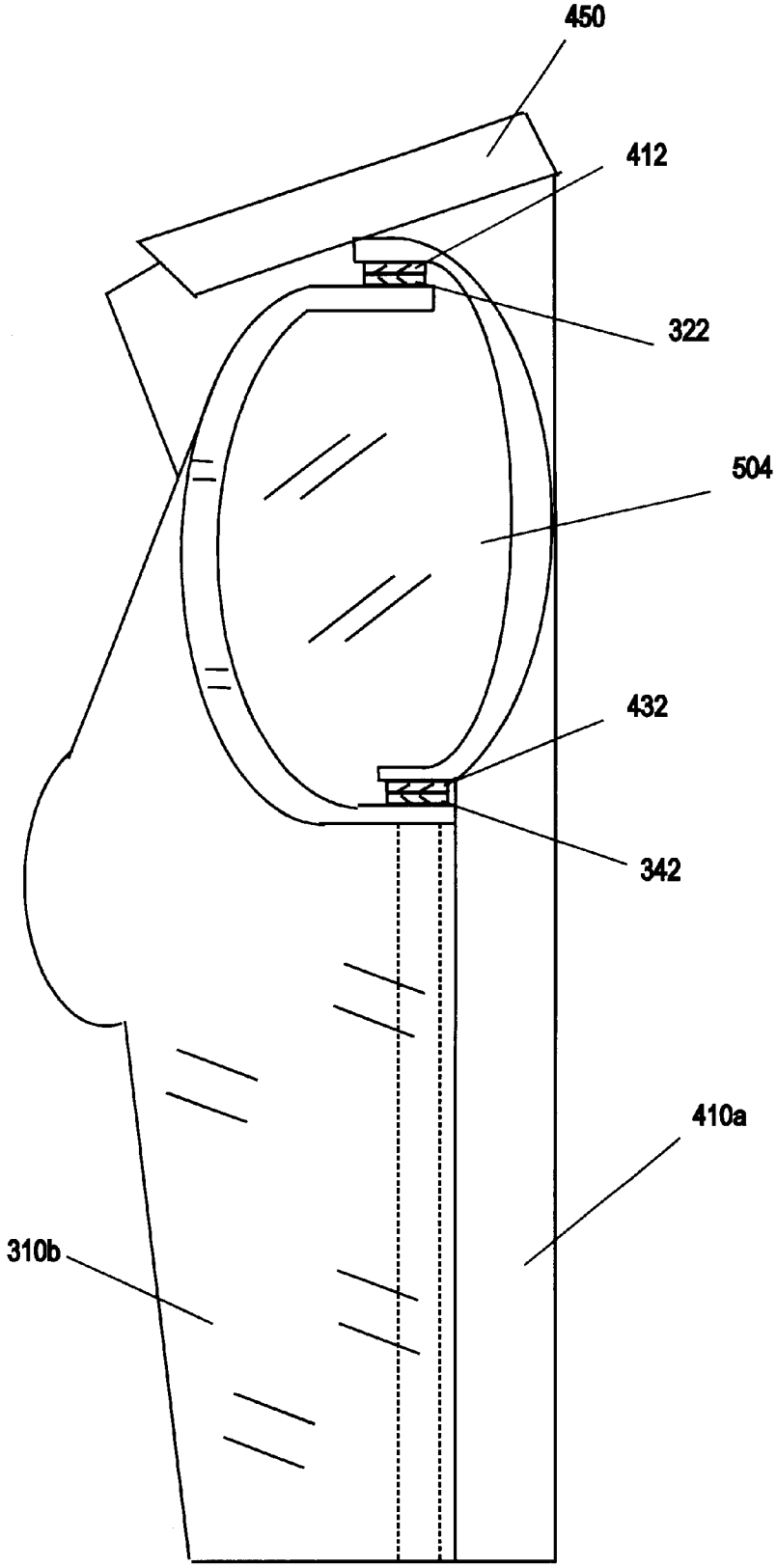
FIGS. 13–14 show right and left side views, respectively, of the removable shirt of the second embodiment as the shirt would appear on a mannequin or a female individual.
Figure 14:
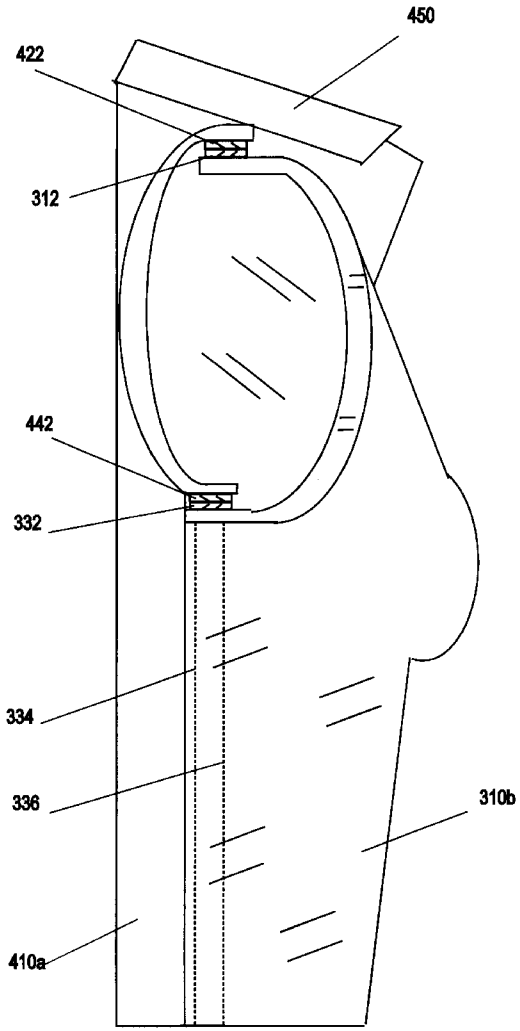

FIGS. 13–14 show right and left side views, respectively, of the removable shirt 470 of the first embodiment as the shirt 470 would appear on a mannequin 510 or a female individual. The mannequin 510 has a trunk 511. FIG. 13 shows the joining of attachment portion 432 (which may be a VELCRO portion) to attachment portion 342 (which may be a mating VELCRO portion). Attachment portions 432 and 342 are joined along the entire right side, except for the opening 551 where the right arm would go. The locations of stitches 346 and 344 are also shown in FIG. 13. FIG. 13 shows side 310*b* of portion 310 and side 410*a* of portion 410. FIG. 13 also shows the joining of attachment portion 412 with attachment portion 322 in the shoulder area.

FIG. 14 shows the joining of attachment portion 442 (which may be a VELCRO portion) to attachment portion 332 (which may be a mating VELCRO portion). Attachment portions 442 and 332 are joined along the entire left side, except for the opening 552 where the left arm would go. The locations of stitches 336 and 334 are also shown in FIG. 14. FIG. 14 shows side 310*b* of portion 310 and side 410*a* of portion 410. FIG. 14 also shows the joining of attachment portion 312 with attachment portion 422 in the shoulder area.

In operation an individual would attach portion 310 to portion 410 as shown by FIGS. 10A–10B. The individual can then use the resulting removable shirt 470. When the individual is done with the removable shirt 470, she may pull the different attachment portions apart to remove the shirt 470. The attachment portions 412, 422, 432, 442, 452, and 462 would each be removed, disconnected, or unattached from the attachment portions 322, 312, 332, 342, 352, and 362, respectively. An individual can perform this removal or unattachment operation while the individual has another shirt on. Thus for a changeover in tennis, an individual, particularly a woman, can place a new shirt over the removable shirt, and then remove the removable shirt 470. This allows the woman to replace a sweaty shirt without exposing herself in public.

I claim:

1. A method comprising the steps of:

providing a first shirt comprising a first portion and a second portion wherein the first portion of the first shirt has a first attachment device;

the second portion of the first shirt has a second attachment device;

providing a second shirt comprising a first portion and a second portion wherein the first portion of the second shirt has a first attachment device;

the second portion of the second shirt has a second attachment device;

attaching the first attachment device of the first shirt to the second attachment device of the first shirt in order to attach the first portion of the first shirt to the second portion of the first shirt;

placing the first shirt on;

attaching the first attachment device of the second shirt to the second attachment device of the second shirt in order to attach the first portion of the second shirt to the second portion of the second shirt; and placing the second shirt over the first shirt removing the first shirt while the second shirt is on;

detaching the first attachment device of the first shirt from the second attachment device of the first shirt in order to detach the first portion of the first shirt from the second portion of the first shirt; and removing the first shirt by detaching the first attachment device of the first shirt from the second attachment device of the first shirt while the second shirt is on.

2. The method of claim 1 further comprising providing a hook fastener for the first attachment device of the first shirt;

and providing a loop fastener for the second attachment device of the first shirt.

3. The method of claim 1 further comprising providing a plurality of attachment portions for the first attachment device of the first shirt;

and providing a plurality of attachment portions for the second attachment device of the first shirt.

4. The method of claim 3 further comprising providing first, second, third, and fourth attachment portions for the first attachment device of the first shirt;

providing first, second, third, and fourth attachment portions for the second attachment device of the first shirt;

and wherein the first, second, third, and fourth attachment portions of the first attachment device of the first shirt attach to the first, second, third, and fourth attachment portions of the second attachment device of the first shirt, respectively.

5. The method of claim 4 further comprising providing a left shoulder area, a right shoulder area, a left side area, and a right side area for the first portion of the first shirt, providing a left shoulder area, a right shoulder area, a left side area, and a right side area for the second portion of the first shirt;

wherein the first and second attachment portions of the first attachment device of the first shirt are located near the left and right shoulder areas, respectively of the first portion of the first shirt;

the third and fourth attachment portions of the first attachment device of the first shirt are located near the left and right side areas, respectively of the first portion of the first shirt;

the first and second attachment portions of the second attachment device of the first shirt are located near the left and right shoulder areas, respectively of the second portion of the first shirt; and the third and fourth attachment portions of the second attachment device of the first shirt are located near the left arid right side areas, respectively of the second portion.

6. The method of claim 1 further comprising:

participating in athletics after placing the first shirt on and before placing the second shirt over the first shirt;

and participating in athletics after placing the second shirt over the first shirt and after removing the first shirt while the second shirt is on.

7. The method of claim 6 wherein participating in athletics includes playing tennis.

8. The method of claim 1 further comprised of:

detaching the first attachment device of the second shirt from the second attachment device of the second shirt in order to detach the first portion of the second shirt from the second portion of the second shirt;

and removing the second shirt by detaching the first attachment device of the second shirt from the second attachment device of the second shirt while the second shirt is on.

9. The method of claim 8 further comprising:

participating in athletics after placing the first shirt on and before placing the second shirt over the first shirt;

and participating in athletics after placing the second shirt over the first shirt and after removing the first shirt while the second shirt is on.

10. The method of claim 9 wherein participating in athletics includes playing tennis.

11. The method of claim 8 further comprised of:

placing a third shirt over the second shirt after the first shirt has been removed and before removing the second shirt.

12. The method of claim 11 further comprising:

participating in athletics after placing the first shirt on and before placing the second shirt over the first shirt;

participating in athletics after placing the second shirt over the first shirt, after removing the first shirt while the second shirt is on, and before placing the third shirt over the second shirt;

participating in athletics after placing the third shirt over the second shirt and after removing the second shirt while the third shirt is on.

13. The method of claim 12 wherein participating in athletics includes playing tennis.

* * * * *

UNITED STATES PATENT AND TRADEMARK OFFICE

CERTIFICATE OF CORRECTION

PATENT NO. : 6,282,718 B1
DATED : September 4, 2001
INVENTOR(S) : Melvin L. Drakeford It is certified that error appears in the above-identified patent and that said Letters Patent is hereby corrected as shown below:

Title page,
Item [12], "DRAKFORD" should read -- DRAKEFORD --.
Item [76], "Melvin Drakford" should read -- Melvin Drakeford --.

Signed and Sealed this

Twenty-fourth Day of September, 2002

*Attest:*

*Attesting Officer*

JAMES E. ROGAN
*Director of the United States Patent and Trademark Office*